US007768200B2

(12) United States Patent
Hwang

(10) Patent No.: US 7,768,200 B2
(45) Date of Patent: Aug. 3, 2010

(54) PLASMA DISPLAY PANEL HAVING BLACK MATRICES

(75) Inventor: Tae Su Hwang, Gumi-si (KR)

(73) Assignee: LG Electronics Inc., Seoul (KR)

( * ) Notice: Subject to any disclaimer, the term of this patent is extended or adjusted under 35 U.S.C. 154(b) by 634 days.

(21) Appl. No.: 11/341,897

(22) Filed: Jan. 30, 2006

(65) Prior Publication Data

US 2006/0170354 A1 Aug. 3, 2006

(30) Foreign Application Priority Data

Feb. 2, 2005 (KR) ..... 10-2005-0009591

(51) Int. Cl.
*H01J 17/49* (2006.01)

(52) U.S. Cl. ..... 313/582; 313/292

(58) Field of Classification Search ..... 313/582–587, 313/292; 345/60

See application file for complete search history.

(56) References Cited

U.S. PATENT DOCUMENTS 5,892,492 A * 4/1999 Osawa et al. ..... 345/60
5,939,826 A * 8/1999 Ohsawa et al. ..... 313/582
6,498,430 B1 * 12/2002 Sakai et al. ..... 313/582
2003/0151362 A1 * 8/2003 Alberto et al. ..... 313/586
2005/0218807 A1 * 10/2005 Min ..... 313/582

FOREIGN PATENT DOCUMENTS

JP 2004-006427 1/2004
KR 10-1998-073576 11/1998
KR 10-2001-0003713 A 1/2001

OTHER PUBLICATIONS

Translation of JP 2004-006427.*
Korean Office Action dated Oct. 18, 2006.
Chinese Office Action dated Aug. 22, 2008.

* cited by examiner

*Primary Examiner*—Karabi Guharay
(74) *Attorney, Agent, or Firm*—KED & Associates, LLP

(57) ABSTRACT

The present invention relates to a plasma display panel. The plasma display panel includes black matrices formed in a front substrate, and first barrier ribs, which are formed opposite to the black matrices on a rear substrate and partition pixel cells. The first barrier ribs have a width wider than that of the black matrices. Even if misalignment occurs during a process of adhering substrates, the black matrices do not protrude into discharge spaces. Therefore, the defective ratio can be lowered and the picture quality can be improved.

14 Claims, 7 Drawing Sheets

PLASMA DISPLAY PANEL HAVING BLACK MATRICES

BACKGROUND OF THE INVENTION

1. Field of the Invention

The present invention relates to a plasma display panel apparatus, and more particularly, to a black matrix formed on a front substrate and barrier ribs formed on a rear substrate for improved contrast.

2. Discussion of Related Art

In general, a plasma display panel apparatus includes discharge cells formed between a rear substrate having barrier ribs formed therein and a front substrate opposite to the rear substrate. The plasma display panel apparatus implements images by light-emitting phosphors with vacuum ultraviolet rays generated when an inert gas within each of the discharge cells is discharged by a high frequency voltage.

FIG. 1 is a plan view of electrodes formed in a general plasma display panel. FIG. 2 is a cross-sectional view of a discharge cell of the general plasma display panel.

The discharge cell is formed on a rear substrate 18 opposite to a front substrate 10 by a plurality of barrier ribs 24 partitioning discharge spaces.

An address electrode 12X is formed on the rear substrate 18. Scan electrode 12Y and sustain electrode 12Z are formed in pairs on the front substrate 10. As shown in FIG. 1, the address electrodes 12X cross the scan electrode 12Y and the sustain electrode 12Z. The front substrate 10 shown in FIG. 2 is rotated by 90°.

A dielectric layer 22 for accumulating wall charges is formed on the rear substrate 18 having the address electrodes 12X formed therein.

The barrier ribs 24 are formed on the dielectric layer 22Z, forming the discharge spaces between the barrier ribs. The barrier ribs 24 prevent ultraviolet rays generated by a discharge and a visible ray from leaking to neighboring discharge cells. Phosphors 26 are coated on surfaces of the dielectric layer 22 and the barrier ribs 24.

An inert gas is injected into the discharge space. The phosphors 26 are excited by ultraviolet rays generating during a discharge of the gas, generating one of red, green and blue visible rays.

Each of the scan electrode 12Y and the sustain electrode 12Z formed in the front substrate 10 includes a transparent electrode 12*a* and a bus electrode 12*b*. The scan electrode 12Y and the sustain electrode 12Z cross the address electrodes 12X. A dielectric layer 14 and a protection film 16 covering the scan electrode 12Y and the sustain electrode 12Z are also formed on the front substrate 10.

The discharge cell constructed above is selected by a counter discharge between the address electrodes 12× and the scan electrode 12Y, and then has its discharge sustained by a surface discharge between the scan electrode 12Y and the sustain electrode 12Z, thus radiating a visible ray.

Each of the scan electrode 12Y and the sustain electrode 12Z includes a transparent electrode 12*a*, and a bus electrode 12*b*, which has a width smaller than that of the transparent electrode and is formed at one side edge of the transparent electrode.

FIG. 3 shows the configuration of a frame that drivers a general plasma display panel.

Referring to FIG. 3, the plasma display panel is driven with one frame being time-divided into several sub-fields having a different number of emissions in order to implement gray levels of images. Each of the sub-fields includes a reset period for initializing wall charges within discharge cells, an address period for selecting a scan line and selecting a discharge cell in the selected scan line, and a sustain period for implementing gray levels depending on a number in which a sustain discharge is generated.

Gray levels that are implemented in the sub-fields including the reset period, the address period and the sustain period are accumulated during one frame. In the case where images are sought to be displayed with 256 gray levels, a frame period (16.67 ms) corresponding to 1/60 seconds is divided into eight sub-fields (SF1 to SF8), as shown in FIG. 3. Gray levels of $2^n$ (n=0, 1, 2, 3, 4, 5, 6, 7) are represented in each sub-field.

The plasma display panel that displays images using the driving method as shown in FIG. 3 improves the contrast ratio through optimization of a waveform applied to each of electrodes or the contrast ratio through the blackening of the front substrate 10. To this end, FIG. 4 shows a cross-sectional view of a discharge cell structure in which a black matrix (BM) is formed.

Referring to FIG. 4, a black matrix 17 is formed between an upper dielectric layer 14 of a front substrate 10 and a protection film 16, and is opposite to barrier ribs 24.

That is, the black matrix 17 is formed in the front substrate 10 so that it is overlapped with the barrier ribs 24 parallel to an address electrode X. Therefore, the black matrix 17 can improve the contrast ratio while not covering the display region through which light is transmitted in each of the discharge cells.

The black matrix 17 in the related art is formed to have substantially the same width as that of the barrier ribs 24 that partition the discharge cells. In the case where alignment is inconsistent when the front substrate 10 is combined with the rear substrate 18, the front substrate 10 or the rear substrate 18 is fluctuated right and left. Therefore, the black matrix 17 is not completely overlapped with the barrier ribs 24 and discharge spaces are covered. As a result, a problem arises because the picture quality is degraded.

SUMMARY OF THE INVENTION

Accordingly, the present invention has been made in view of the above problems, and it is an object of the present invention to provide a black matrix formed on a front substrate and barrier ribs formed on a rear substrate for improved contrast.

A plasma display panel according to an aspect of the present invention includes black matrices formed in a front substrate, and first barrier ribs, which are formed opposite to the black matrices on a rear substrate and partition pixel cells. The first barrier ribs have a width wider than that of the black matrices.

The width of the first barrier ribs may be set in the range of 80 μm to 100 μm and the width of the black matrix may be set within a range of 30 μm to 50 μm. The black matrices may be located within the edges of the first barrier ribs. At this time, the first barrier ribs may have a width, which is 1.5 to 3 times, preferably, 1.5 to 2 times wider than that of the black matrix.

One or more second barrier ribs that partition respective discharge cells may be formed between the first barrier ribs. At this time, the first barrier ribs and the second barrier ribs may be parallel to the data electrode formed in the rear substrate.

The width of the first barrier ribs may be set to be wider than that of the second barrier ribs and may be 1.5 to 2.5 times wider than that of the second barrier ribs. The width of the second barrier ribs may be set in the range of 40 μm to 60 μm.

Furthermore, second black matrices may be further formed at locations opposite to the second barrier ribs other than the first black matrix formed at locations opposite to the first barrier ribs. The width of the first black matrix may be wider than that of the second black matrices.

Therefore, in accordance with the present invention, a width of barrier ribs opposite to a black matrix is formed wider than that of the black matrix. Therefore, even when misalignment occurs during a process, the black matrix does not protrude into discharge spaces.

DETAILED DESCRIPTION OF PREFERRED EMBODIMENTS

A barrier rib structure and a plasma display panel having a black matrix structure according to the present invention will now be described in connection with embodiments with reference to the accompanying drawings.

Embodiments of a plasma display panel according to the present invention can be plural. Therefore, the present invention is not limited to an embodiment described in the present specification.

Figure 1:
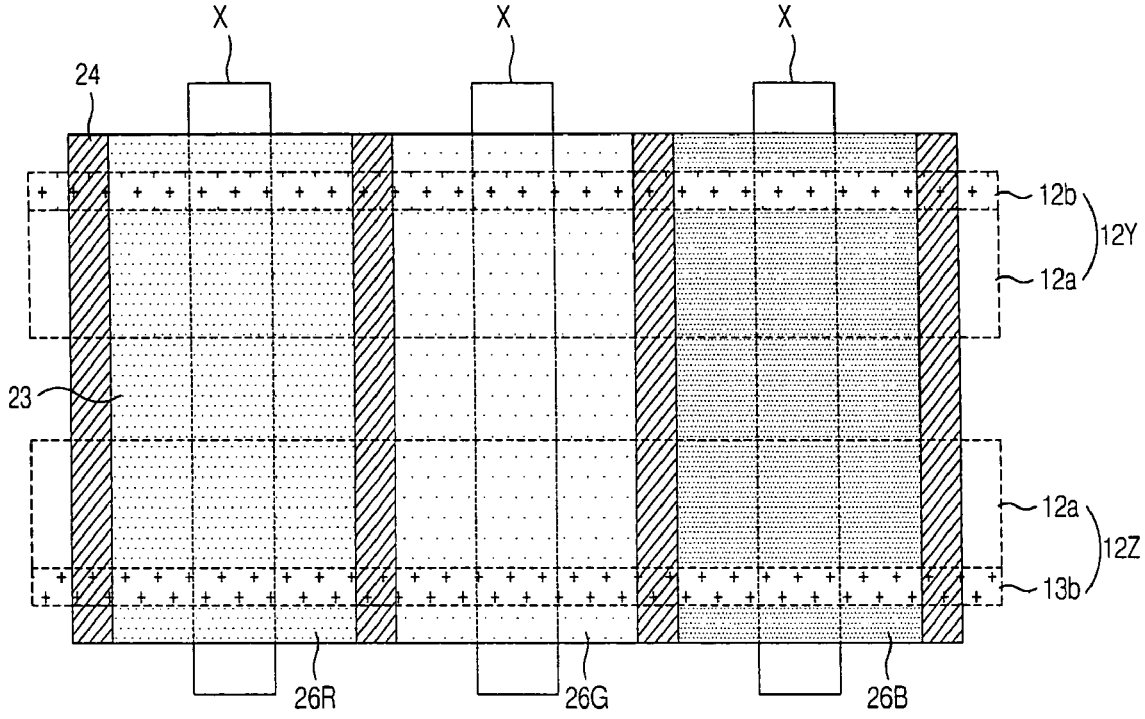
FIG. 1 (Prior Art)
FIG. 1 is a plan view of electrodes formed in a general plasma display panel.
Figure 2:
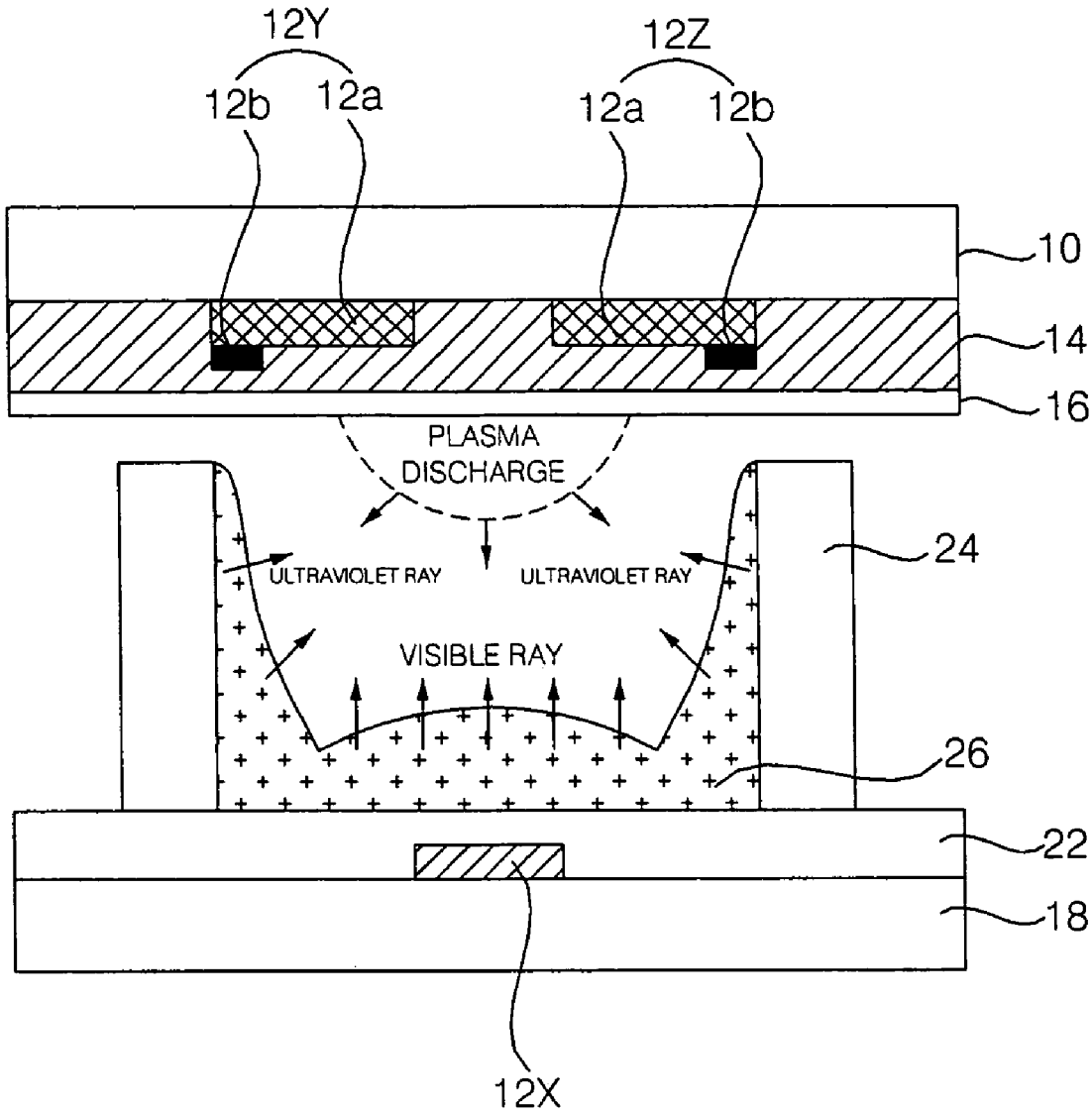
FIG. 2 (Prior Art)
FIG. 2 is a cross-sectional view of a discharge cell of the general plasma display panel.
Figure 3:
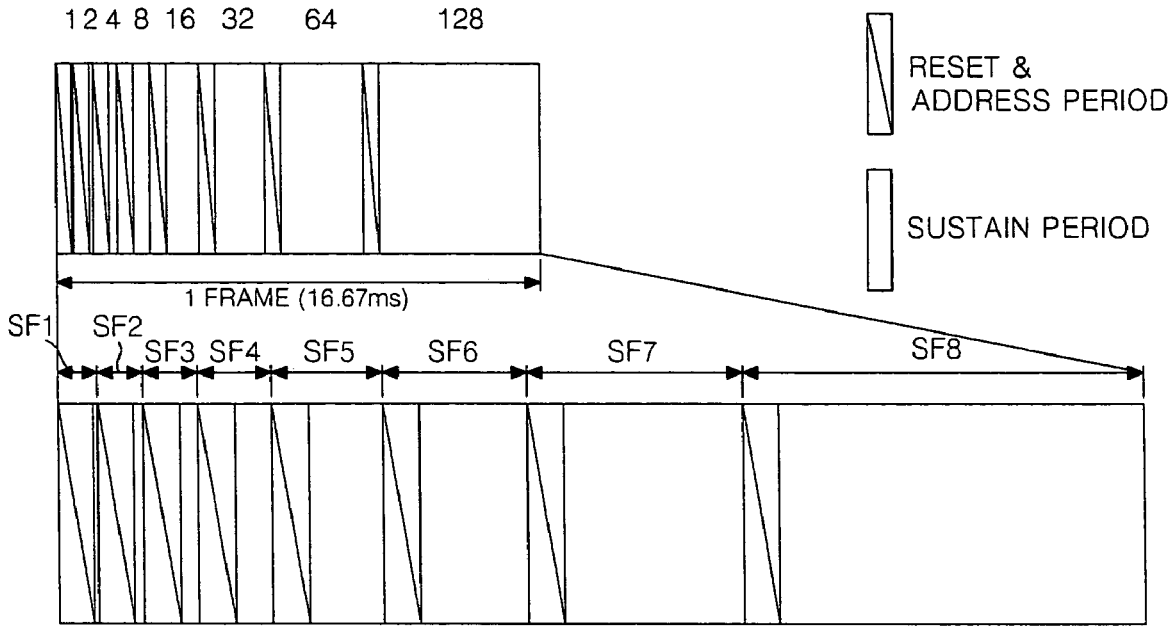
FIG. 3 (Prior Art)
FIG. 3 shows the configuration of a frame that drivers a general plasma display panel.
Figure 4:
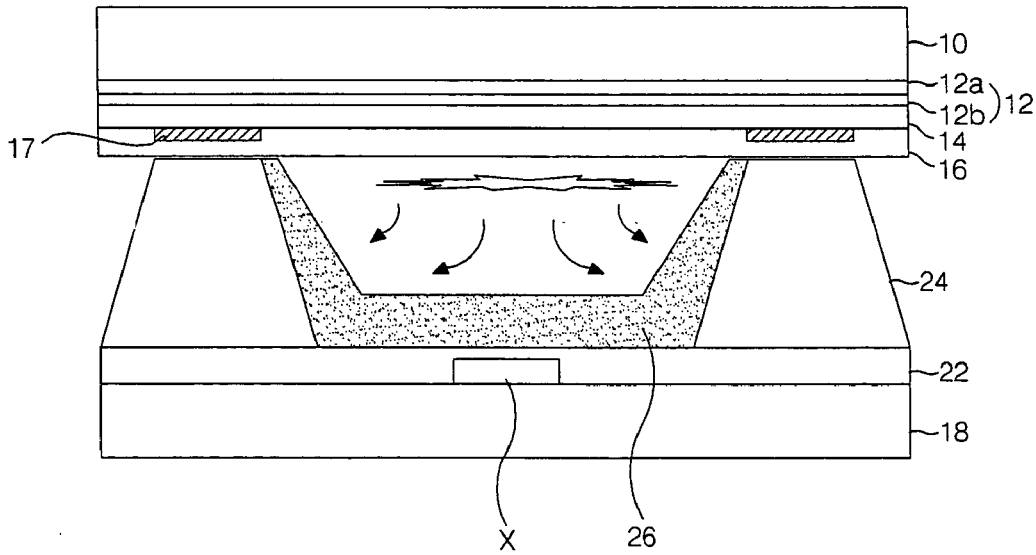
FIG. 4 (Prior Art)
FIG. 4 is a cross-sectional view of a discharge cell structure in which a black matrix (BM) is formed.
Figure 5:
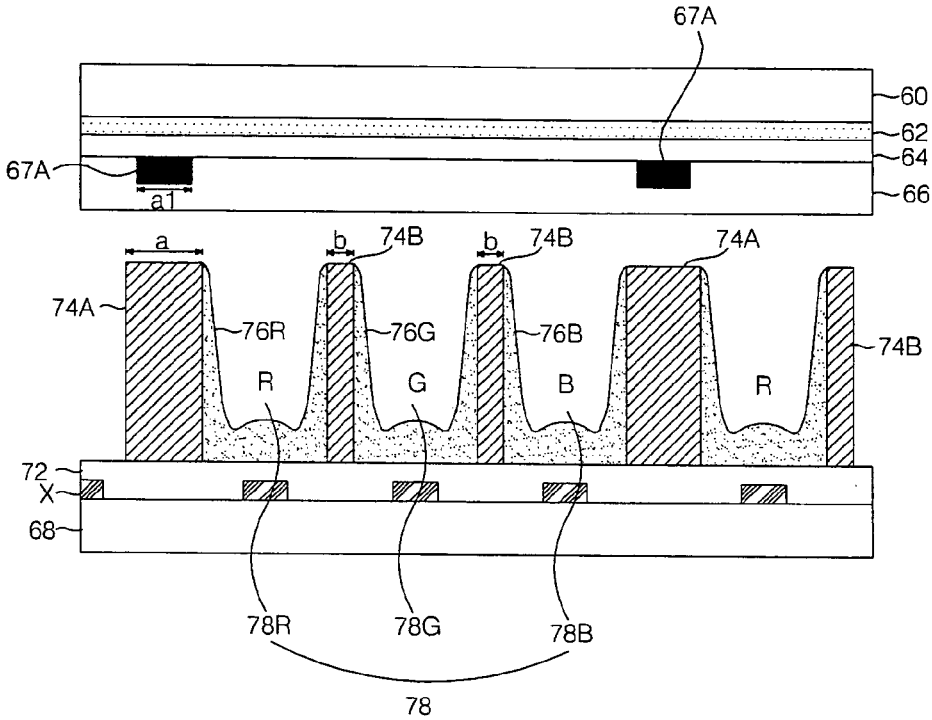
FIG. 5 is a cross-sectional view of a discharge cell of a plasma display panel according to a first embodiment.
Figure 6:
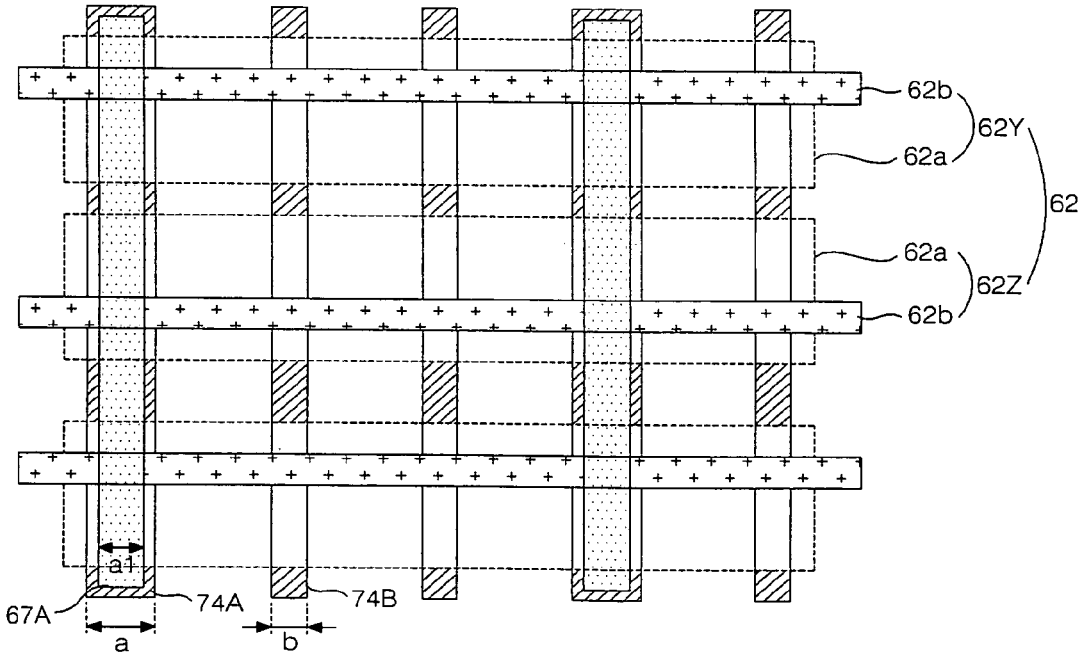
FIG. 6 is a plan view of electrodes of a plasma display panel according to a first embodiment.

FIGS. 5 and 6 are views regarding a barrier rib structure and a plasma display panel having a black matrix structure according to a first embodiment of the present invention. In FIG. 5, a black matrix formed in a front substrate is opposite to first barrier ribs that partition pixel cells and a width of the first barrier ribs is formed wider than that of the black matrix. The structure shown in FIG. 5 does not decrease the aspect ratio of discharge spaces.

In a front substrate 60 is formed an upper electrode 62. A dielectric layer 64 is laminated to cover the upper electrode 62. Black matrices 67A are then formed on the dielectric layer 64. A protection film 66 is formed to cover the black matrices 67A.

Address electrodes X are formed on a rear substrate 68, which forms discharge spaces in such a way as to be opposite to the front substrate 60. A dielectric layer 72 is laminated to cover the address electrodes X. Furthermore, barrier ribs 74A, 74B that partition the discharge spaces and R, G and B sub-pixels are formed in the dielectric layer 72. In this case, the barrier ribs 74A, 74B include a first barrier rib 74A partitioning pixel cells, and a second barrier rib 74B partitioning a sub-pixel.

As shown in the drawings, the address electrodes X cross the upper electrode 62. The black matrices 67A are parallel to the address electrodes X.

As shown in FIG. 6, the upper electrodes 62 are scan electrodes 62Y and sustain electrodes 62Z. Each of the scan electrodes 62Y and the sustain electrodes 62Z includes a transparent electrode 62*a*, and a metal bus electrode 62*b*, which has a width smaller than that of the transparent electrode and is formed at one side edge of the transparent electrode.

The transparent electrode 62*a* is generally formed of metal, such as Indium Tin Oxide (ITO), Indium Zinc Oxide (IZO) or Indium Tin Zinc Oxide (ITZO). The metal bus electrode 62*b* is generally formed of metal, such as chrome (Cr), and is formed on the transparent electrode 62*a*. The metal bus electrode 62*b* functions to decrease a voltage drop incurred by the transparent electrode 62*a* with a high resistance.

The dielectric layers 64, 72 are formed to surround the electrodes 62Y,62Z and X formed in the front substrate 60 and the rear substrate 68. Wall charges formed due to a gas discharge are accumulated on the dielectric layers 64, 72.

The protection film 66 is formed of magnesium oxide (MgO) and functions to prevent damage to the dielectric layer 64, which is incurred by sputtering generated during a discharge of plasma, and also increase emission efficiency of secondary electrons. Therefore, the dielectric layers 64, 72 and the protection film 66 function to lower a firing voltage.

The barrier ribs 74A, 74B provide the discharge spaces along with the front substrate 60 and the rear substrate 68 and function to prevent ultraviolet rays generated by a discharge of a gas and a visible ray from leaking to neighboring discharge cells. Furthermore, it has been described that the barrier ribs of the present embodiment are the first barrier ribs 74A and the second barrier ribs 74B formed in a direction parallel to the address electrodes X (a longitudinal direction), but can be formed in a traverse direction crossing the address electrodes X.

The discharge spaces are filled with an inert gas, such as He, Ne, Ar, Xe or Kr for a gas discharge, a mixed discharge gas of them, or an excimer gas capable of generating ultraviolet rays through a discharge.

Furthermore, phosphor layers 76R, 76G and 76B are coated on the barrier ribs 74A, 74B or the dielectric layer 72 within the discharge spaces and are excited by ultraviolet rays generated during a discharge of plasma to generate any visible ray of red (R), green (G) and blue (B) The first barrier ribs 74A are barrier ribs that partition the pixel cell. One pixel cell 78 includes sub-pixels 78R, 78G and 78B that generate R, G or B visible rays, respectively. Furthermore, the second barrier ribs 74B are barrier ribs that partition the sub-pixels 78R, 78G and 78B.

The first barrier rib 74A and the second barrier rib 74B have different widths. A width (a) of the first barrier rib is formed wider than a width (b) of the second barrier rib. The width (b) of the second barrier rib 74B is formed in the range of 40 μm to 60 μm and the width (a) of the first barrier rib 74A is formed in the range of 80 μm to 100 μm. Furthermore, the width (a) of the first barrier rib is formed to be 1.5 to 2.5 times wider than the width (b) of the second barrier rib.

The black matrices 67A are formed between the first barrier ribs 74A, which have a width wider than that of the second barrier ribs 74B as described above, and the front substrate 60.

In this case, the black matrices 67A can be formed on any layer of the front substrate 60. For example, the black matrices 67A can be formed outside the front substrate 60, between the front substrate 60 and the upper dielectric layer 64, between the upper dielectric layer 64 and the protection film 66, outside the protection film 66 or the like. Locations where the black matrices 67A are formed may be decided taking a manufacturing process, manufacturing efficiency, manufacturing cost, etc. into consideration.

The black matrix 67A in the front substrate 60 has a width (a1) narrower than the width (a) of the first barrier rib 74A so that it does not cover the discharge space, and is formed at a location that is not at all deviated from the first barrier rib 74A. At this time, the width (a1) of the black matrix 67A is set within a range of 30 μm to 50 μm.

Furthermore, the width (a) of the first barrier rib 74A is formed to be 1.5 to 3 times wider than the width (a1) of the black matrix. The width (a) of the first barrier rib 74A can be formed to be 1.5 to 2 times wider than the width (a1) of the black matrix depending on manufacturing technology in which the barrier ribs 74A, 74B or the black matrices 67A are formed.

Figure 7:
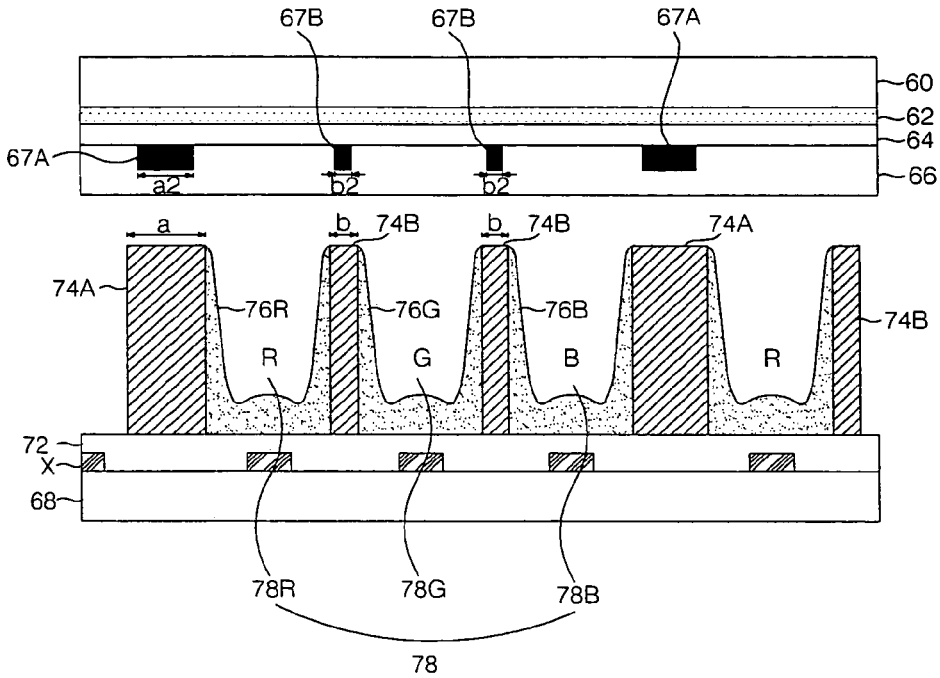
FIG. 7 is a cross-sectional view of a discharge cell of a plasma display panel according to a second embodiment.
Figure 8:
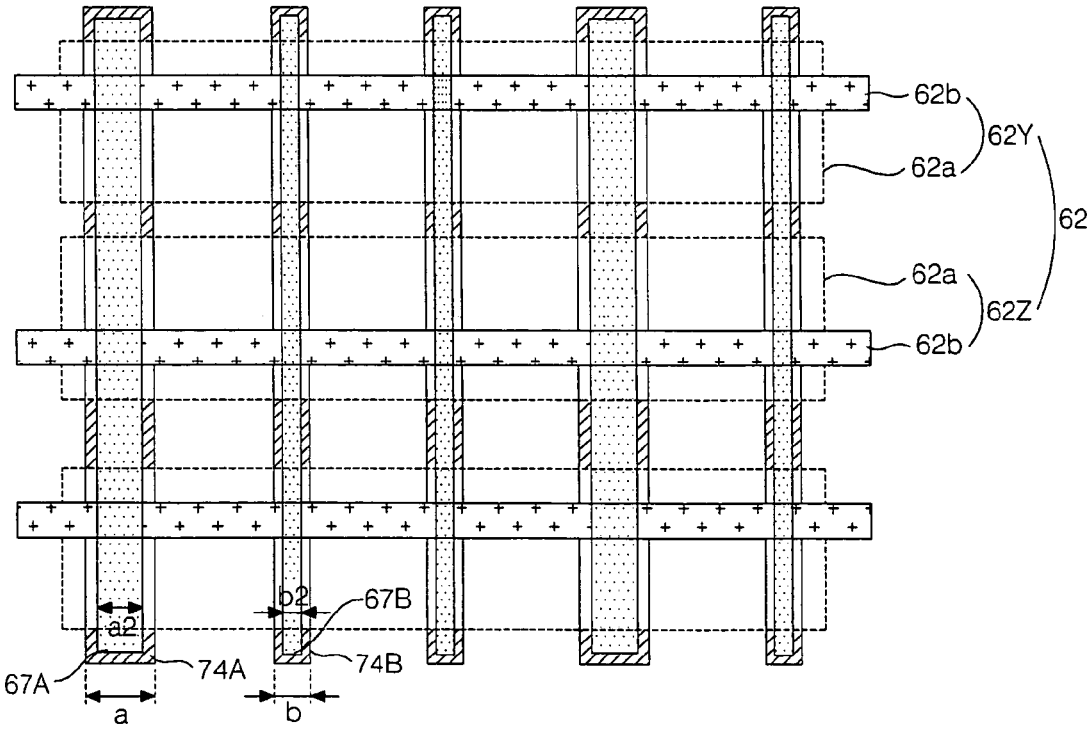
FIG. 8 is a plan view of electrodes of a plasma display panel according to a second embodiment.

FIGS. 7 and 8 are views regarding a barrier rib structure and a plasma display panel having a black matrix structure according to a second embodiment of the present invention. In FIG. 7, first black matrices 67A are opposite to first barrier ribs 74A that partition pixel cells. Second black matrices 67B are opposite to second barrier ribs 74B that partition a sub-pixel. A width (a) of the first barrier rib 74A is formed wither than a width (a2) of the first black matrix 67A. A width (b) of the second barrier rib 74B is formed wither than a width (b2) of the second black matrix 67B. This structure shown in FIG. 7 does not degrade the aspect ratio of the discharge spaces.

In this case, the first barrier rib 74A and the second barrier rib 74B are formed in the same manner as the first embodiment. The width (a) of the first barrier rib is formed to 80 μm to 100 μm and the width (b) of the second barrier rib is formed to 40 μm to 60 μm. Furthermore, the width (a) of the first barrier rib is formed to be substantially 1.5 to 2.5 times wider than the width (b) of the second barrier rib.

The first black matrices 67A have a width narrower than that of the first barrier ribs 74A so that they are not at all deviated from the first barrier ribs, in the same manner as the first embodiment. At this time, the width (a2) of the first black matrix is set in the range of 30 μm to 50 μm.

In a similar way, the second black matrices 67B have a width narrower than the width (b) of the second barrier ribs 74B and are formed at locations that are not at all deviated from the second barrier ribs 74B. At this time, the width (b2) of the second black matrix 74B is set in the range of 20 μm to 40 μm.

Therefore, the width (a2) of the first black matrix 67A according to a second embodiment of the present invention is formed wider than the width (b2) of the second black matrix 67B. The second black matrices 67B are additionally formed. As a result, there is an advantage in that the contrast ratio can be enhanced in comparison with the first embodiment.

Figure 9:
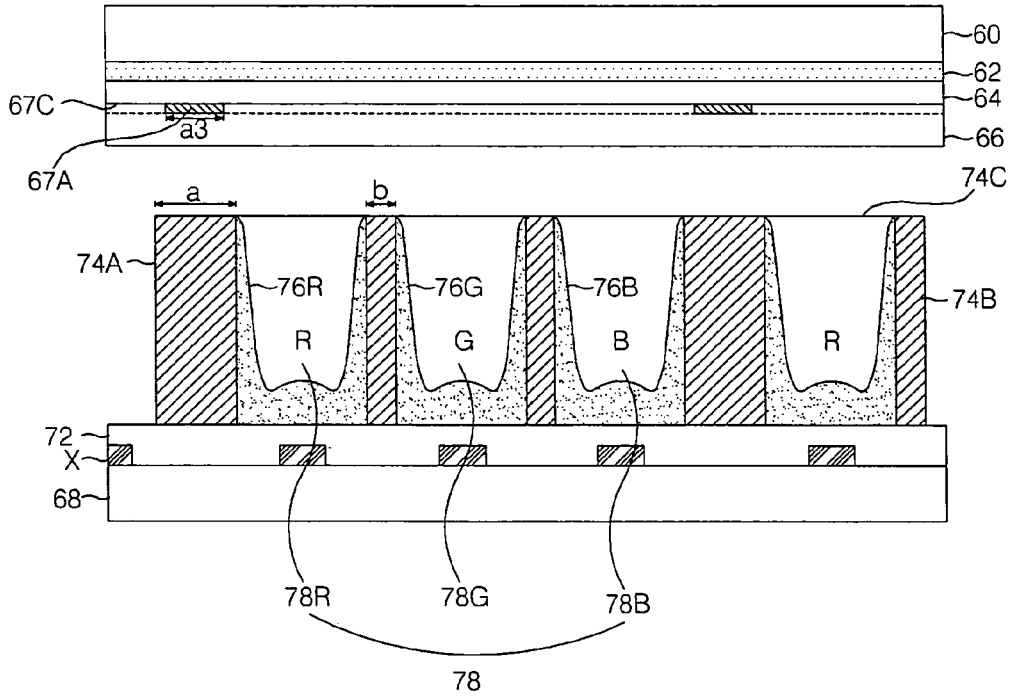
FIG. 9 is a cross-sectional view of a discharge cell of a plasma display panel according to a third embodiment.
Figure 10:
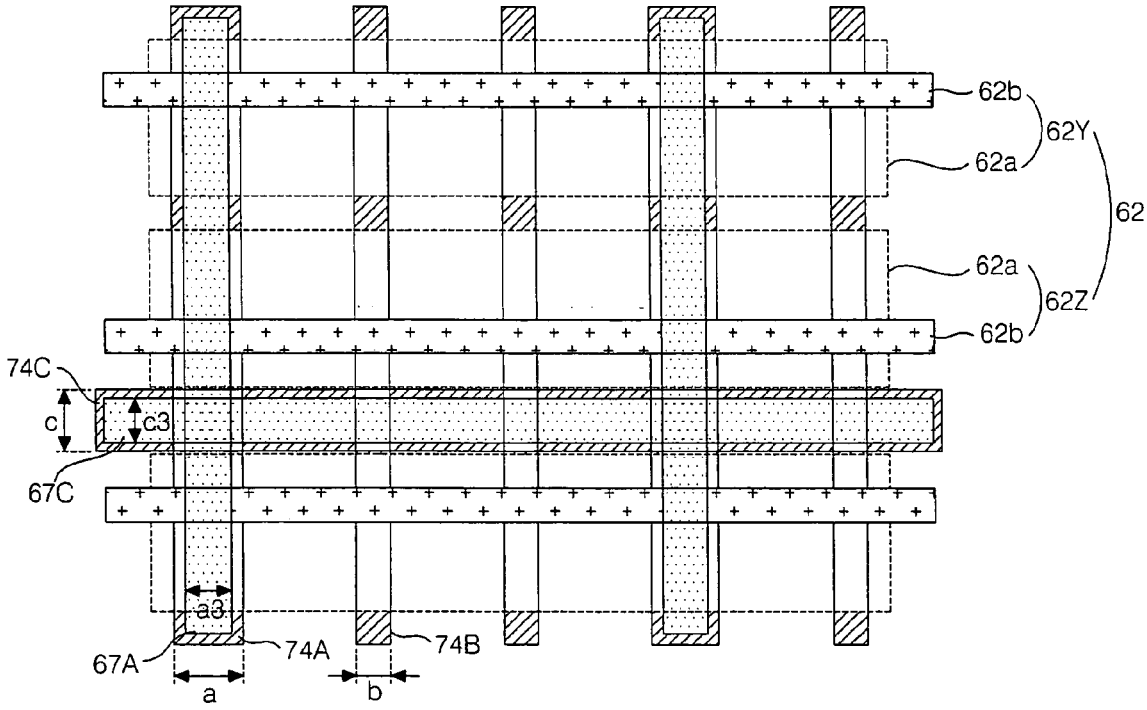
FIG. 10 is a plan view of electrodes of a plasma display panel according to a third embodiment.

FIGS. 9 and 10 are views regarding a barrier rib structure and a plasma display panel having a black matrix structure according to a third embodiment of the present invention. In FIG. 9, first black matrices 67A are opposite to first barrier ribs 74A that partition pixel cells. Third black matrices 67C cross the first black matrices 67A.

That is, the first black matrices 67A are opposite to the first barrier ribs 74A formed parallel to address electrodes X (a longitudinal direction). The third black matrices 67C are opposite to third barrier ribs 74C formed parallel to sustain electrodes 62Z or scan electrodes 62Y (a traverse direction).

The first black matrices 67A have a width narrower than the width (a) of the first barrier ribs and are formed at locations that are not at all deviated from the first barrier ribs 74A, in the same manner as the first embodiment. At this time, the width (a3) of the first black matrix 67A is set in the range of 30 μm to 50 μm.

In the same manner, the third black matrices 67C have a width narrower than the width (c) of the third barrier ribs 74C and are formed at locations that are not at all deviated from the third barrier ribs 74C. At this time, the width (c) of the third barrier ribs 74C is set within a range of 80 μm to 100 μm and the width (c3) of the third black matrices 67C is set within a range of 30 μm to 50 μm.

Therefore, in accordance with a third embodiment of the present invention, the third black matrices 67C cross the first black matrices 67A. There is an advantage in that the contrast ratio is enhanced in comparison with the first embodiment.

Figure 11:
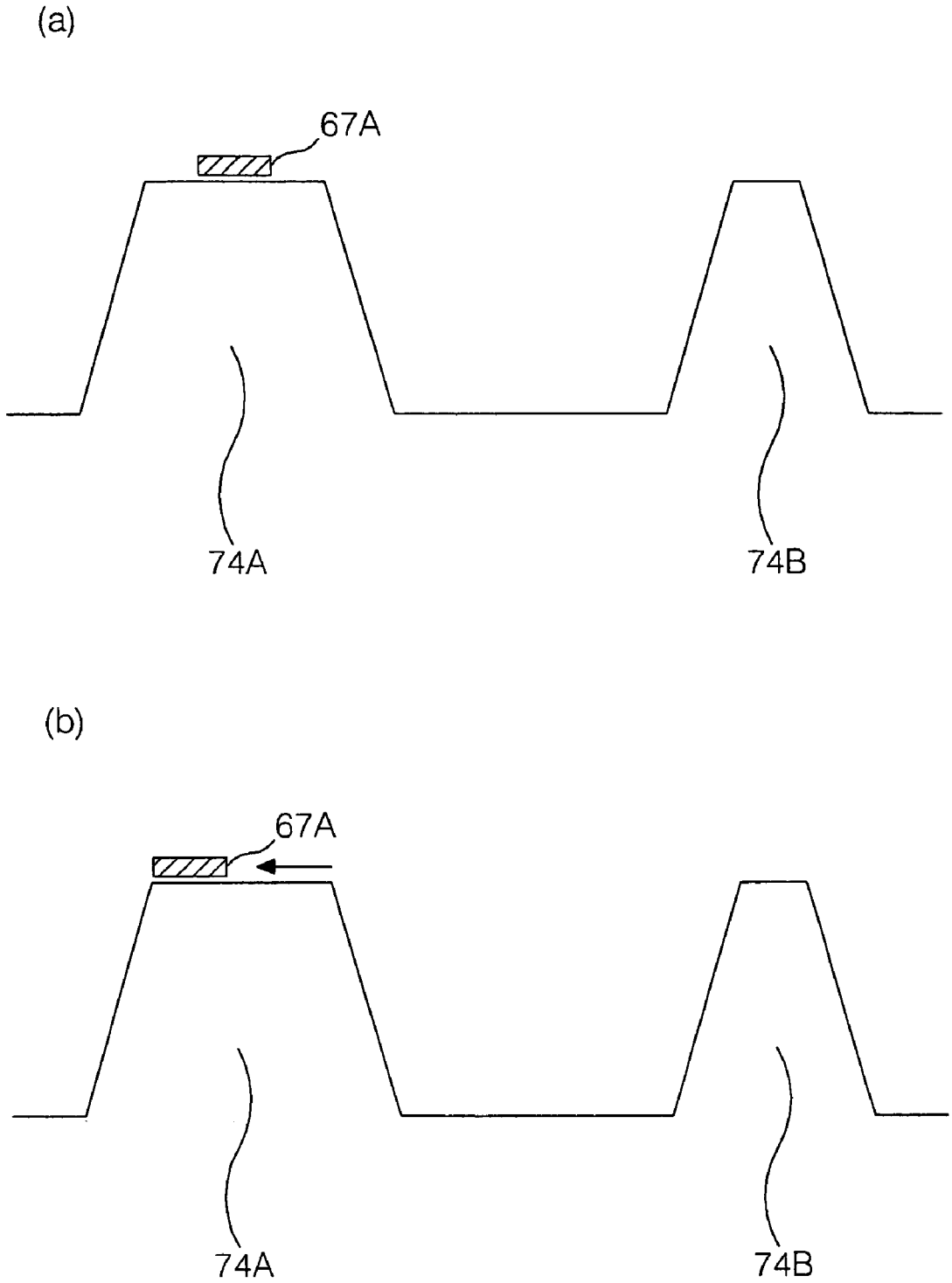
FIG. 11 is a view showing a location where a black matrix is formed according to the present invention.

FIG. 11 shows a black matrix and a first barrier rib when a front substrate and a rear substrate are adhered.

During a process of adhering a front substrate having black matrices formed therein and a rear substrate having barrier ribs formed therein, while the front substrate and the rear substrate are aligned, one of the front substrate and the rear substrate is frequently fluctuated in the right and left directions by several μm to several tens of μm.

In this case, in the plasma display panel of the related art, barrier ribs and black matrices opposite to the barrier ribs have substantially the same width. In the case where the barrier ribs and the black matrices are misaligned, the black matrices are partially shielded by the discharge spaces. In the present invention, however, as shown in FIG. 11(*b*), a width of the first barrier rib 74A opposite to the black matrix 67A is formed wider than a width of the black matrix 67A. Therefore, even if misalignment occurs, the black matrix does not shield the discharge space.

Furthermore, in the present invention, a width of some of the barrier ribs 74A,74B, more particularly, the first barrier rib 74A partitioning the pixel cell 78, not the entire barrier ribs, is formed to be wide. Therefore, a reduction of discharge spaces can be minimized and the defective ratio due to misalignment can be lowered.

Furthermore, the first barrier ribs 74A are not limited to barrier ribs that partition the pixel cell, but can include barrier ribs that partition a predetermined unit of sub-pixel groups or pixel cell groups.

Although the foregoing description has been made with reference to the preferred embodiments, it is to be understood that changes and modifications of the present invention may be made by the ordinary skilled in the art without departing from the spirit and scope of the present invention and appended claims.

What is claimed is:

1. A plasma display panel, comprising:

first black matrices formed in a front substrate;

first barrier ribs, which are formed opposite to the first black matrices on a rear substrate, the first barrier ribs to partition pixel cells;

one or more second barrier ribs that partition respective sub-pixels formed between the first barrier ribs; and second black matrices formed in the front substrate at locations opposite to the second barrier ribs, the second black matrices and the second barrier ribs being parallel wherein a width of the first black matrices is greater than a width of the second black matrices, wherein each pixel cell includes the sub-pixels that generate red, green and blue visible rays, wherein the first barrier ribs have a width greater than a width of the first black matrices, wherein the width of the first barrier ribs is greater than a width of the second barrier ribs, and wherein the sub-pixels have a same size.

2. The plasma display panel as claimed in claim 1, wherein the width of the second barrier ribs is in a range of 40 μm to 60 μm.

3. The plasma display panel as claimed in claim 1, wherein the width of the first barrier ribs is 1.5 to 2.5 times greater than the width of the second barrier ribs.

4. The plasma display panel as claimed in claim 1, wherein the first black matrices are located within edges of the first barrier ribs.

5. The plasma display panel as claimed in claim 1, wherein the first barrier ribs include a barrier rib parallel to a data electrode formed in the rear substrate, and a barrier rib crossing the data electrode.

6. The plasma display panel as claimed in claim 5, wherein the first black matrices are respectively formed opposite to the barrier rib parallel to the data electrode and the barrier rib crossing the data electrode.

7. The plasma display panel as claimed in claim 1, wherein the width of the first barrier ribs is within a range of 80 μm to 100 μm.

8. The plasma display panel as claimed in claim 1, wherein the width of the first black matrices is within a range of 30 μm to 50 μm.

9. The plasma display panel as claimed in claim 1, wherein the width of the first barrier ribs is 1.5 to 3 times greater than the width of the first black matrices.

10. The plasma display panel as claimed in claim 1, wherein the width of the first barrier ribs is 1.5 to 2 times greater than the width of the first black matrices.

11. A plasma display panel comprising:

at least two first barrier ribs on a first substrate to partition pixels;

at least two second barrier ribs on the first substrate between the at least two first barrier ribs to partition sub-pixels, wherein each sub-pixel has a substantially same size;

at least two first black matrices on a second substrate each at a location opposite to a corresponding one of the at least two first barrier ribs; and second black matrices formed on the second substrate at locations opposite to the at least two second barrier ribs, the second black matrices being parallel to the at least two second barrier ribs wherein a width of each of the first black matrices is greater than a width of each of the second black matrices, wherein each pixel includes the sub-pixels that generate red, green and blue visible rays, wherein each of the first barrier ribs have a width greater than a width of each of the at least two first black matrices, and wherein the width of each of the first barrier ribs is greater than a width of each of the second barrier ribs.

12. The plasma display panel as claimed in claim 11, wherein the first black matrices are located within edges of the at least two first barrier ribs.

13. The plasma display panel as claimed in claim 11, wherein the first barrier ribs include a barrier rib parallel to a data electrode formed at the first substrate, and a barrier rib crossing the data electrode.

14. The plasma display panel as claimed in claim 13, wherein the at least two first black matrices are respectively formed opposite to the barrier rib parallel to the data electrode and the barrier rib crossing the data electrode.

* * * * *